US008790132B2

(12) United States Patent
Kashiyama et al.

(10) Patent No.: US 8,790,132 B2
(45) Date of Patent: Jul. 29, 2014

(54) FIXING STRUCTURE OF CONNECTOR

(75) Inventors: Motohisa Kashiyama, Makinohara (JP); Masanobu Oishi, Fujieda (JP)

(73) Assignee: Yazaki Corporation, Tokyo (JP)

( * ) Notice: Subject to any disclaimer, the term of this patent is extended or adjusted under 35 U.S.C. 154(b) by 149 days.

(21) Appl. No.: 13/502,201

(22) PCT Filed: Jan. 14, 2011

(86) PCT No.: PCT/JP2011/051037

§ 371 (c)(1),
(2), (4) Date: Apr. 16, 2012

(87) PCT Pub. No.: WO2011/087150

PCT Pub. Date: Jul. 21, 2011

(65) Prior Publication Data

US 2012/0208396 A1 Aug. 16, 2012

(30) Foreign Application Priority Data

Jan. 15, 2010 (JP) ..... 2010-006487

(51) Int. Cl.
*H01R 13/73* (2006.01)

(52) U.S. Cl.
USPC ..... 439/564; 439/545

(58) Field of Classification Search
USPC ..... 439/595, 563–565, 570, 545
See application file for complete search history.

(56) References Cited

U.S. PATENT DOCUMENTS 3,838,382 A 9/1974 Sugar
4,902,247 A * 2/1990 Suzuki et al. ..... 439/595
5,123,862 A 6/1992 Suzuki
5,205,755 A 4/1993 Douty et al.
6,030,242 A * 2/2000 Cunningham et al. ..... 439/247
6,144,278 A 11/2000 Nishida et al.
6,155,857 A * 12/2000 Kato et al. ..... 439/248
6,437,673 B1 8/2002 Nishida et al.

(Continued)

FOREIGN PATENT DOCUMENTS

EP 0306635 A2 3/1989
JP 11204958 A 7/1999

OTHER PUBLICATIONS

International Search Report dated Apr. 4, 2011 in counterpart international application No. PCT/JP2011/051037.

(Continued)

*Primary Examiner* — Xuong Chung Trans
(74) *Attorney, Agent, or Firm* — Sughrue Mion, PLLC

(57) ABSTRACT

A fixing structure of a connector includes a housing and a rear holder fixing the housing to a casing by screws. The rear holder has a base plate opposing the casing. First through holes are formed on the base plate so as to correspond to second openings for leading out conductive parts of the female terminals respectively. Terminal holding members are respectively provided at the first through holes for contacting the female terminals respectively. The screws are inserted respectively through second through holes which are arranged so as to deviate to one side with respect to a center of gravity of a region in which the first through holes are formed. Elasticity of one of the terminal holding members which is disposed at a first position facing at least one of the second through holes in a peripheral part of the region are smaller than elasticity of another one of the terminal holding members which is disposed at a position except for the first position.

4 Claims, 5 Drawing Sheets

(56) References Cited

U.S. PATENT DOCUMENTS

| | | | | |
|---|---|---|---|---|
| 7,445,498 | B2 * | 11/2008 | Tsuo | 439/562 |
| 7,914,327 | B2 * | 3/2011 | Campbell et al. | 439/595 |
| 2007/0093126 | A1 | 4/2007 | Tsuo | |
| 2009/0186523 | A1 | 7/2009 | Campbell et al. | |

OTHER PUBLICATIONS

Written Opinion dated Apr. 4, 2011 in counterpart international application No. PCT/JP2011/051037.

* cited by examiner

FIXING STRUCTURE OF CONNECTOR

TECHNICAL FIELD

The present invention relates to a fixing structure of a connector, and particularly to the fixing structure of the connector in which a female connector including plural female terminals is inserted and fixed in an opening of a casing in which an electronic device is accommodated.

BACKGROUND ART

Conventionally, an electronic device mounted in an automobile etc. is generally protected by being accommodated in a casing. The electronic device of the inside of the casing is generally electrically connected to an electronic component etc. of the outside via a connector. For example, a configuration in which a female connector is attached to an opening disposed in a casing and a male connector connected to an electronic device of the inside is inserted in the female connector is adopted. A conductive part led out of the female connector inserted and fixed in the opening of the casing is connected to an electronic component etc. disposed in the outside of the casing by soldering.

However, when a male terminal connected to the electronic device of the inside of the casing is inserted in a female terminal, an insertion force of the male terminal is applied to a solder connection of the electronic component etc. of the outside of the casing via the female terminal, and the electronic component etc. may be damaged. Therefore, a structure of fixing the female terminal so as not to move by the insertion force of the male terminal is desired.

Generally, in order to fix a circuit component so as not to move, fixation by sandwiching a circuit substrate by a rib projected from an upper surface and a lower surface of the inside of a casing when the circuit substrate is accommodated in the casing of an AC adapter used in an electronic device is proposed as described in, for example, PTL 1.

CITATION LIST

Patent Literature

[PTL 1] JP-A-11-204958

SUMMARY OF INVENTION

Technical Problem

The conventional art described in PTL 1 etc. does not consider a problem of damage etc. from application of an external force to a solder connection to an electronic component etc. of the outside due to movement of a female terminal by an insertion force when a male connector is inserted in a female connector.

The problem that the present invention is to solve is to prevent an external force from being applied to the solder connection to the electronic component etc. of the outside due to the movement of the female terminal by the insertion force when the male connector is inserted in the female connector.

First, a configuration in which a female connector is inserted and fixed in an opening disposed in a casing in which an electronic device is accommodated and a male connector connected to the electronic device of the inside is inserted in the female connector, was examined by the inventors of the present invention.

Therefore, the inventors of the present invention propose the fixing structure having a housing for juxtaposing terminal accommodating chambers in which plural female terminals are respectively accommodated, and a rear holder fixed by plural screws with the housing inserted in an opening formed in a casing of an electronic device. Here, the housing is configured to have a first opening in which a terminal of the other side is inserted in a top of the female terminal, a second opening in which the female terminal can be inserted and a conductive part consecutively installed in a back end is led out, and a projection formed so as to be able to abut against an edge of the opening of the casing by being projected beyond the opening of the casing to an outer edge of an end face in which the second opening is formed. Also, the rear holder is configured to have a base plate opposed to the casing in a state of sandwiching the projection of the housing, plural through holes which are associated with the second openings of the housing and are formed in the base plate, plural terminal holding members which are disposed every through hole and can abut against the female terminals, and plural screw holes in which the plural screws are inserted.

By being configured thus, the base plate of the rear holder is screwed on the casing and the projection of the housing is sandwiched by the base plate and the edge of the opening of the casing and the housing of the female connector is fixed in the opening of the casing.

Incidentally, when the female terminal is formed in a straight shape and is accommodated in the terminal accommodating chamber, the female terminal is inserted from one end of the terminal accommodating chamber and is fixed in the terminal accommodating chamber. In this case, a locking step for positioning a top of insertion of the female terminal is formed in the other end of the terminal accommodating chamber of the insertion side of a male terminal connected to the female terminal. On the other hand, the terminal holding member formed by an elastic member projected from the rear holder is disposed and, for example, a back end of insertion of the female terminal is held by this terminal accommodating chamber and a situation in which the female terminal comes out of the terminal accommodating chamber is regulated.

On the other hand, when the female connector including the plural female terminals is fixed in the casing in which the electronic device is accommodated by the rear holder, a shape of the base plate of the rear holder may be restricted and a position and the number of screw holes for screwing the base plate on the casing may be restricted by various factors such as arrangement of the inside of the casing of the accommodated electronic device, design of connection to an electronic component etc., manufacture of the fixing structure of the connector, restrictions by an installation place, or workability. For example, there is a case in which the plural screw holes for screwing the base plate of the rear holder on the casing must be formed in a position of deviating from a region of a through hole group formed so as to be able to respectively insert the conductive parts consecutively installed in the back ends of each of the female terminals. Particularly, when a straight line connecting each of the screw holes deviates from the center of gravity of the region, in which the through hole group is formed, to the same side, the following problem may arise.

That is, the projection of the housing of the female connector is sandwiched between the rear holder and the casing, so that a gap may be formed between the casing and a peripheral edge of the rear holder in which the screw holes are formed by manufacturing tolerances etc. of the housing and the rear holder even when a recess for accommodating the projection is formed in the rear holder. Also, rigidity of the base plate of the region in which the through hole group is formed becomes low, and rigidity of the other region, that is, of a peripheral edge of the base plate is maintained high. As a result, when the screw holes are disposed in the peripheral edge of the base plate and the rear holder is fixed in the casing by screw tightening, a terminal holding force transmitted to the terminal holding member formed in the through hole of a position facing the screw increases. On the other hand, a terminal holding force transmitted to the terminal holding member formed in the through hole of a position separate from the screw decreases according to a decrease in rigidity of the base plate. In brief, variations in the terminal holding force occur according to a difference between distances from a position of the through hole to a position of the screw hole, and there is a problem that the female terminal disposed in a position with a reduced terminal holding force moves by an insertion force of the male terminal. Particularly, when the straight line connecting each of the screw holes deviates from the center of gravity of the region, in which the through hole group is formed, to the same side, a range of the difference between distances from the position of the through hole to the position of the screw hole increases, so that variations in the terminal holding force increase. As a result, the female terminal may move to the rear holder side (axis direction) by the insertion force of the male terminal and thereby, damage from application of an external force to a solder connection to an electronic component etc. of the outside may be caused.

Solution to Problem

According to one aspect of the present invention, there is provided a fixing structure of a connector, comprising:

a housing, having a plurality of terminal accommodating chambers configured to respectively accommodate a plurality of female terminals; and a rear holder, by a plurality of screws, fixing the housing inserted into an opening formed in a casing in which an electronic device is accommodated, wherein the housing is formed with a plurality of first openings for insertion of mating terminals and a plurality of second openings for leading out conductive parts of the female terminals respectively, and has a projection contacting an edge portion of the opening of the casing and projected from an end face on which the second openings are formed, the rear holder has a base plate opposing the casing in a state where the projection is disposed therebetween, a plurality of first through holes formed on the base plate and corresponding to the second openings, a plurality of terminal holding members respectively provided at the first through holes and configured to come in contact with the female terminals respectively, and a plurality of second through holes through which the screws are inserted respectively, the second through holes are arranged so as to deviate to one side with respect to a center of gravity of a region in which the first through holes are formed, and elasticity of one of the terminal holding members which is disposed at a first position facing at least one of the second through holes in a peripheral part of the region are smaller than elasticity of another one of the terminal holding members which is disposed at a position except for the first position.

The fixing structure may be configured such that: each of the terminal holding members includes: a leg part which is cantilevered in the rear holder and extends along an inserting direction of the screws; and an arm part which extends from a free end of the leg part and is configured to come in contact with each of the female terminals, so as to form L-shape, and a length of the leg part of the one of the terminal holding members is longer than a length of the leg part of another one of the terminal holding members.

The base plate may have a thin-wall part at the one side with respect to the center of gravity of the region.

The fixing structure may be configured such that: a number of the second through holes is two, a straight line connecting the two second through holes is separated from the center of gravity of the region in which the first through holes are formed.

Advantageous Effects of Invention

The terminal holding force of holding the female terminal correlates with the elastic force of the terminal holding member elastically deformed at the time of tightening the screw, so that the elastic force of the terminal holding member is changed according to the distance from the screw hole. Particularly, the terminal holding member disposed in the position facing the screw hole, in brief, located at the boundary of the region of the through hole group and disposed in the position of the through hole facing the screw hole has a great terminal holding force by a screw tightening force, so that the elastic force of the terminal holding member of this position is reduced and deformation is facilitated and thereby, the terminal holding force is distributed in the position separate from the screw hole and variations in the terminal holding force can be reduced. As a result, the terminal holding force applied to each of the female terminals can be made uniform, so that damage to the electronic component etc. of the outside caused by movement of the female terminal by the insertion force of the male terminal in the casing of inserting the male connector in the female connector can be prevented.

Also, according to the thin part of the base plate, at the time of tightening the screw, the base plate in which the screw holes are formed is deformed and the screw tightening force can be distributed in the region of the through hole group, so that variations in the terminal holding force by which the terminal holding member holds the female terminal can be reduced further.

According to the present invention, the external force can be prevented from being applied to the solder connection to the electronic component etc. of the outside due to the movement of the female terminal by the insertion force when the male connector is inserted in the female connector.

DESCRIPTION OF EMBODIMENTS

Figure 1:
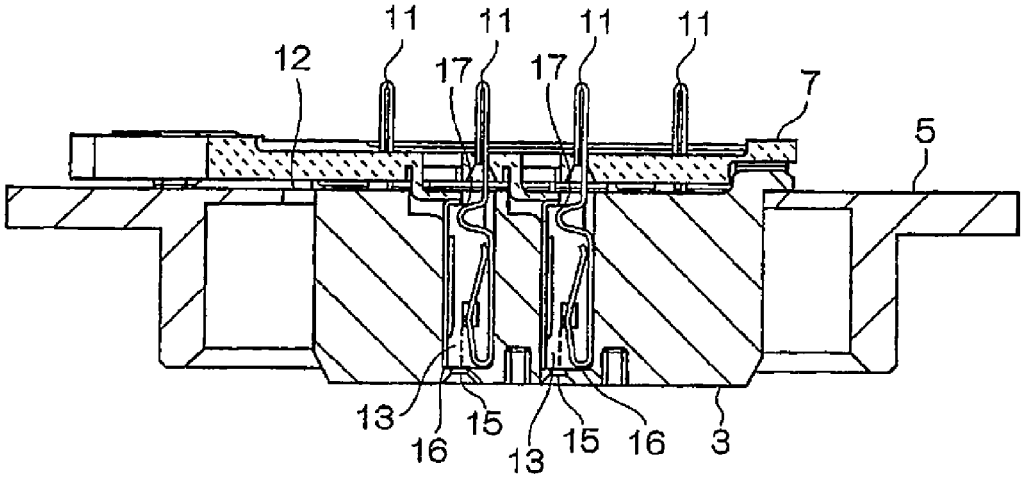
FIG. 1 is a sectional view of a fixing structure of a connector of one embodiment of the present invention.
Figure 2:
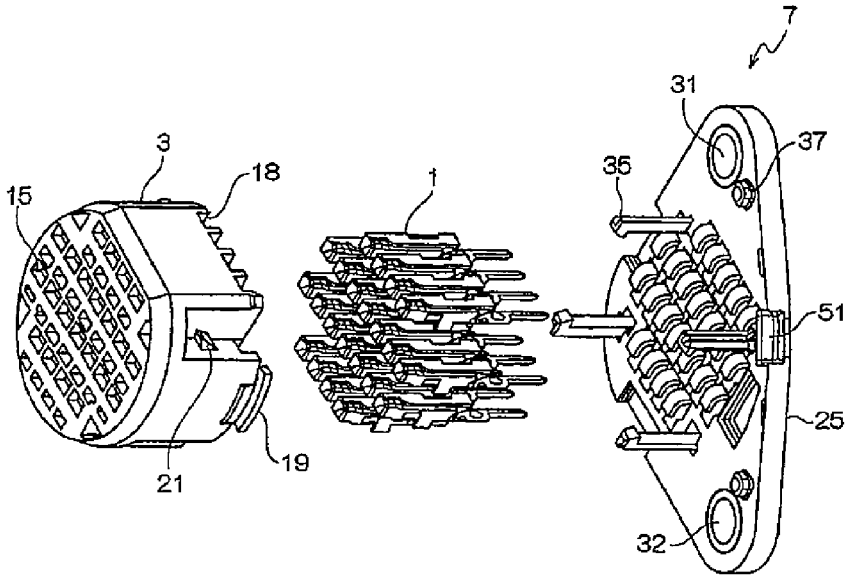
FIG. 2 is an exploded view of the connector of one embodiment of the present invention.
Figure 3:
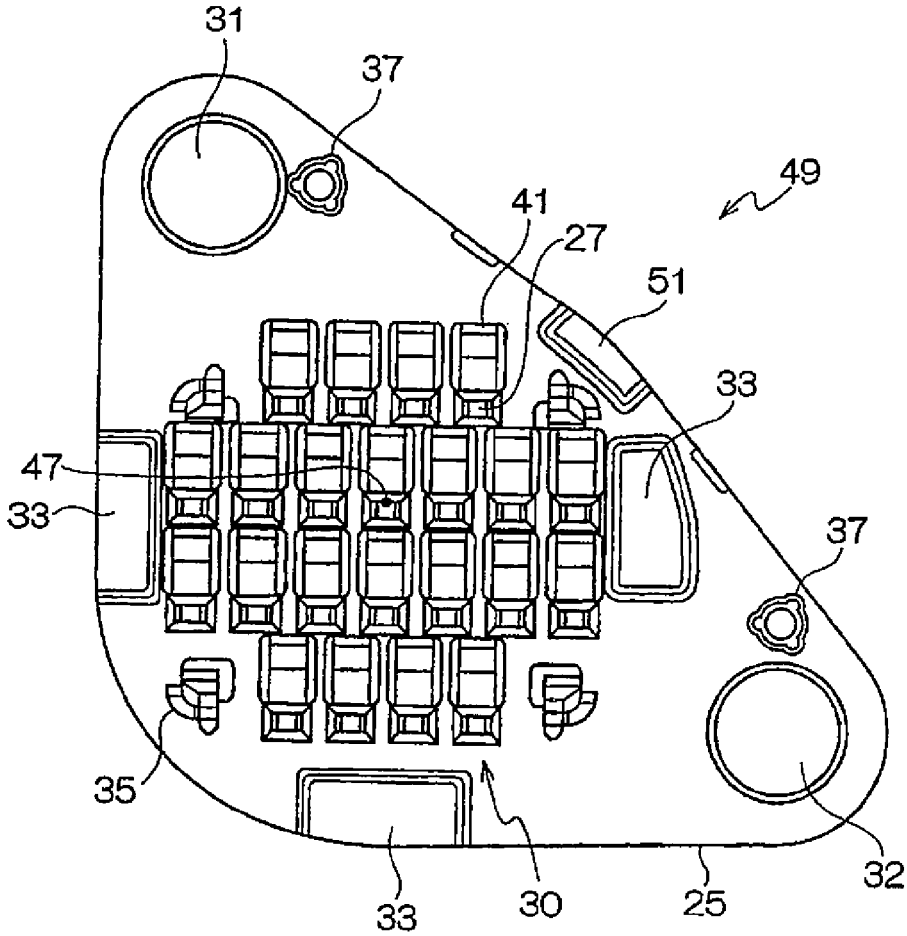
FIG. 3 is a plan view of a rear holder of FIG. 1.

The present invention will hereinafter be described based on an embodiment. As shown in FIGS. 1 to 3, a female connector of the present embodiment has, for example, a columnar housing 3 in which plural female terminals 1 are accommodated, and a rear holder 7 fixed in an outer surface of a casing wall 5 of a casing in which an electronic device, for example, a transmission of an automobile is accommodated by plural screws. The female terminal 1 is formed by, for example, a metal member in a tube shape with a rectangular section and is constructed so as to insert a male terminal from an opening of the top. A chevron-shaped elastic piece for making contact with the male terminal is formed inside the tube. A conductive part 11 connected to, for example, a circuit substrate positioned in the back side through the rear holder 7 by solder etc. is consecutively installed in a back end of the female terminal 1.

The housing 3 is formed by, for example, a resin, and, for example, straight-shaped terminal accommodating chambers 13 in which the plural female terminals 1 are respectively accommodated, first openings 15 in which the other male terminals are inserted in the tops of the female terminals 1, second openings 17 in which the female terminals 1 can be inserted and the conductive parts 11 consecutively installed in the back ends are led out, projections 19 sandwiched by the casing wall 5 and the rear holder 7, and protrusions 21 locked in locking members 35 of the rear holder 7 are formed. The terminal accommodating chamber 13 is formed in a straight shape with a rectangular section and an opening 15 is formed in one end and an opening 17 is formed in the other end. The opening 15 is formed so that the male terminal connected to the electronic device of the inside of the casing can be inserted from the top of the female terminal 1 of the terminal accommodating chamber 13. The opening 17 is formed in a rectangular section capable of inserting the female terminal 1. A locking step 16 in which the top of the female terminal 1 abuts and is positioned is formed on an inner surface of the side of the opening 15 of the terminal accommodating chamber 13. The projection 19 is disposed so as to be able to abut against an edge of an opening 12 of the casing wall 5 by being projected greatly beyond the opening 12 from an outer edge of an end face 18 in which the opening 17 is formed. In the embodiment, the three projections 19 are formed and each of the projections 19 is formed in a flat shape.

The rear holder 7 includes a base plate 25 opposed to the casing wall 5 in a state of sandwiching the projections 19 of the housing 3. Plural through holes 27 (first through holes) corresponding to the openings 17 of the housing 3, plural terminal holding members 41 which are disposed every through hole 27 and can abut against, for example, positions of back ends of the female terminals 1, two screw holes 31, 32 (second through holes) through which two screws for fixing the rear holder 7 on the casing wall 5 are respectively inserted, plural recesses 33 in which the projections 19 of the housing 3 are inserted, the locking members 35 which are locked in the protrusions 21 and fix the housing 3 to the rear holder 7, and protrusions 37 which are inserted in recesses of the casing wall 5 and position the female connector are formed in the base plate 25.

Figure 4:
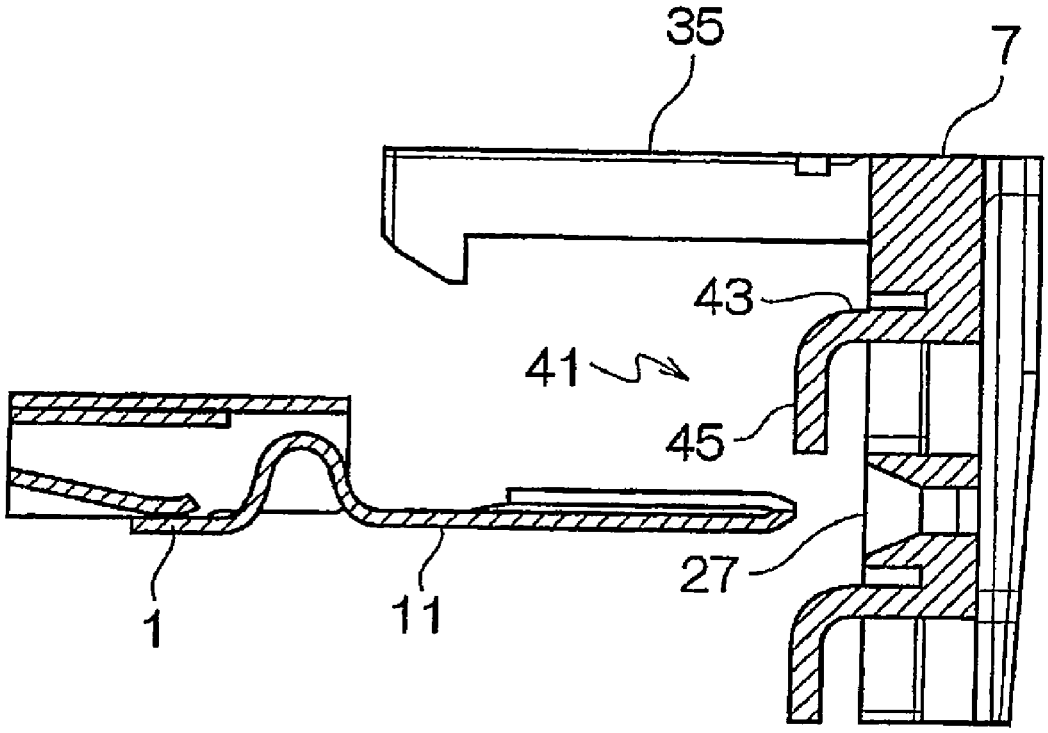
FIG. 4 is an enlarged view of an elastic member of the rear holder of FIG. 3.

The plural through holes 27 are constructed so that the conductive parts 11 of the female terminals 1 are respectively inserted and project from the back side of the rear holder 7. The plural terminal holding members 41 made of, for example, resins for fixing the female terminals 1 are formed in positions corresponding to the respective through holes 27. When the rear holder 7 is screwed, the terminal holding member 41 is constructed so as to abut against the back end of the female terminal 1 and be elastically deformed and hold the female terminal 1 toward the locking step 16. The terminal holding member 41 has a leg part 43 which is cantilevered in the base plate 25 of the rear holder 7 and is extended along a insertion direction of the screw and an arm part 45 which is drooped substantially perpendicularly from a free end of the leg part 43 and can abut against the position of the back end of the female terminal 1, and is formed in substantially an L shape by the leg part 43 and the arm part 45 as shown in FIG. 4. A region 30 of a through hole group is formed in the base plate 25 by the plural through holes 27 and the plural terminal holding members 41.

The screw holes 31, 32 are constructed so that the screws for fixing the rear holder 7 in the casing wall 5 are inserted and the rear holder 7 is fixed in the casing wall 5 by the inserted screws. The recess 33 is formed in correspondence with the projection 19 and is formed more shallowly than a thickness of the projection 19. The protrusion 37 is constructed so as to be fitted into the recess disposed in the casing wall 5 and position the rear holder 7.

Figure 5:
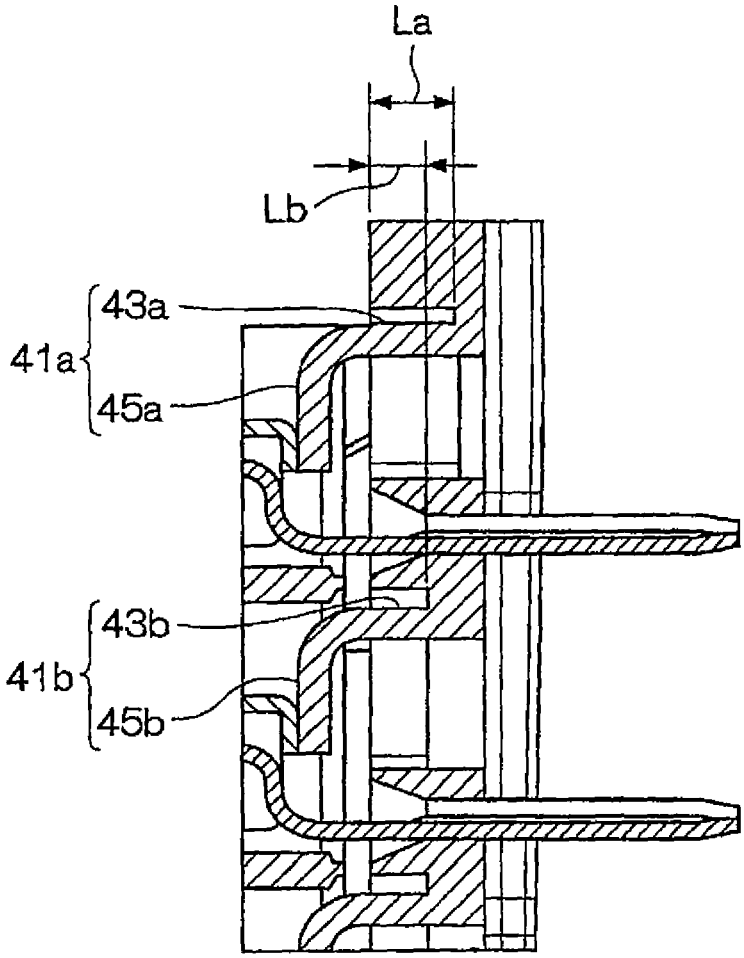
FIG. 5 is a main enlarged view of one embodiment of the present invention.

The screw holes 31, 32 of the rear holder 7 are arranged with a straight line connecting the screw holes 31, 32 separated from the center 47 of gravity of the region 30 of the through hole group, that is, the axis center of the region 30 of the through hole group of a direction in which the plural terminal holding members 41 hold the female terminals 1. Also, a length of the leg part 43 of the terminal holding member 41 is changed according to a distance from the screw holes 31, 32 as shown in FIG. 5. In brief, a length $L_a$ of a leg part 43*a* of a terminal holding member 41*a* which is located at a boundary of the region 30 of the through hole group and is formed in the through hole 27 of a position facing the screw holes 31, 32 is formed longer than a length $L_b$ of a leg part 43*b* of a terminal holding member 41*b* formed in the through hole 27 of a position separate from the screw holes 31, 32. Further, a thin-wall part 51 for thinning a thickness of the base plate 25 is disposed in a portion of the outer edge of a region 49 in which the screw holes 31, 32 are formed. The thin-wall part 51 is formed in an edge of the base plate 25 opposite to the center 47 of gravity with respect to the straight line connecting the screw holes and is formed in a position corresponding to substantially the center of the straight line connecting the screw holes 31, 32.

A structure of fixing the female connector constructed thus in the casing wall 5 of the casing in which the electronic device is accommodated will be described. As shown in FIG. 1, the rear holder 7 is positioned in the side of the openings 17 of the housing 3 and the conductive parts 11 are inserted in each of the through holes 27 of the rear holder 7 and are projected to the back side of the rear holder 7. In this case, the locking members 35 of the rear holder 7 are locked in the protrusions 21 of the housing 3 and the rear holder 7 is fixed in the housing 3. The housing 3 fixed in the rear holder 7 is inserted in the opening 12 of the casing wall 5 of the casing in which the electronic device is accommodated, and each of the projections 19 is abutted against the edge of the opening 12. In this state, screws are inserted in the screw holes 31, 32 of the rear holder 7 and are screwed into screw holes formed in the casing wall 5 and the rear holder 7 is fixed in the casing wall 5. Consequently, each of the projections 19 is sandwiched by the edge of the opening 12 of the casing wall 5 and each of the recesses 33 of the rear holder 7, and the housing 3 is fixed in the casing wall 5. At this time, movement of a direction of insertion of the female terminals 1 is regulated by the locking steps 16 on which the tops of the female terminals 1 abut, so that the arm parts 45 of the terminal holding members 41 of the base plate 25 abut against the back ends of the female terminals 1 and the leg parts 43 are elastically deformed. Consequently, the female terminals 1 are held inside the terminal accommodating chambers 13 by an elastic force from the terminal holding members 41. In addition, each of the projections 19 is formed thicker than a depth of each of the recesses 33 in consideration of manufacturing tolerances etc. of each of the projections 19 and each of the recesses 33, so that a gap is formed between the casing wall 5 and the rear holder 7.

Next, operation of the embodiment will be described. Rigidity of the base plate 25 of the region 30 of the through hole group becomes low by the plural through holes 27, and rigidity of the other region, that is, of a peripheral edge of the base plate 25 is maintained high. As a result, when the screw holes 31, 32 are formed with the screw holes deviating from the region 30 of the through hole group, a screw tightening force transmitted to the terminal holding member 41*a* formed in the through hole 27 of the position facing the screw at the time of tightening the screw increases and a terminal holding force increases. On the other hand, a screw tightening force transmitted to the terminal holding member 41*b* formed in the through hole 27 of the position separate from the screw decreases according to a decrease in rigidity of the base plate 25 and a terminal holding force decreases.

Figure 6:
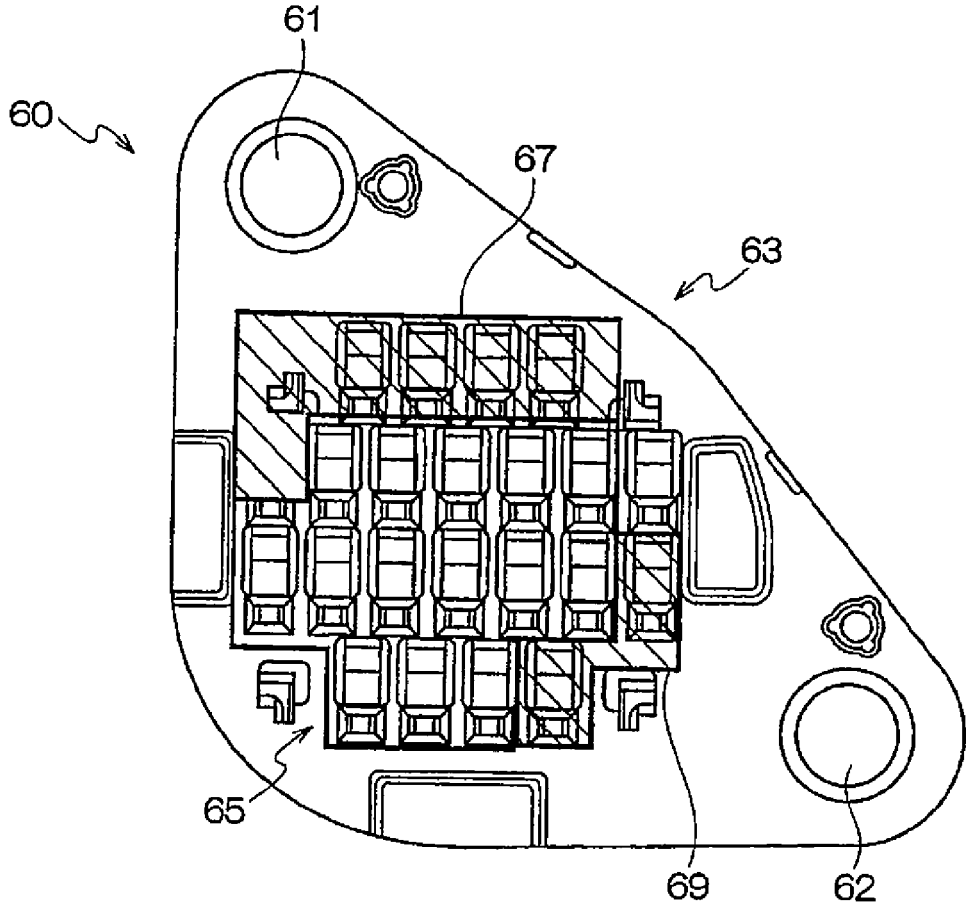
FIG. 6 is a view showing variations in a terminal holding force of a terminal holding member.

For example, when screw holes 61, 62 are formed with the screw holes deviating from a region 65 of a through hole group in a conventional rear holder 60 shown in FIG. 6, transmission of the screw tightening force is large in terminal holding members formed in through holes of regions 67, 69 shown by a slash near to the screw holes 61, 62 and the terminal holding force increases. On the other hand, transmission of the screw tightening force is small in terminal holding members formed in through holes separate from the screw holes 61, 62 and the terminal holding force decreases. In brief, variations in the terminal holding force occur according to a difference between distances from a position of the through hole to a position of the screw hole, so that female terminals disposed in positions with a small terminal holding force move by an insertion force of male terminals, and damage from application of an external force to a solder connection to an electronic component etc. of the outside may be caused.

Therefore, in the embodiment, the leg part 43*a* of the terminal holding member 41*a* in the position near to the screw hole is formed longer than the leg part 43*b* of the terminal holding member 41*b* in the position separate from the screw hole and an elastic force of the terminal holding member 41*a* is reduced. That is, the terminal holding force of holding the female terminal 1 correlates with a restoring force of the terminal holding member elastically deformed at the time of tightening the screw, so that the elastic force of the terminal holding member 41 is changed according to the distance from the screw holes 31, 32. According to this, the leg part 43*a* of the terminal holding member 41*a*, with a great terminal holding force, near to the screw holes 31, 32 tends to be deformed and the terminal holding force decreases, so that the terminal holding force can accordingly be distributed to the terminal holding member 41*b* in the position separate from the screw holes 31, 32 and variations in the terminal holding force of each of the terminal holding members 41 can be reduced.

Further, the thin-wall part 51 is formed in the region 49 of the base plate 25 in which the screw holes 31, 32 are formed, and rigidity of the region of the base plate 25 in which the screw holes 31, 32 are formed is decreased. According to this, at the time of tightening the screw, the base plate 25 is deformed in a position of the thin-wall part 51 and the screw tightening force transmitted from the region 49 to the region 30 of the through hole group can be distributed. In brief, each of the terminal holding members 41 obtains the terminal holding force by the screw tightening force, so that variations in the terminal holding force of each of the terminal holding members 41 can be reduced further by distributing the screw tightening force.

According to the fixing structure of the female connector of the embodiment as described above, the external force can be prevented from being applied to the solder connection to the electronic component etc. of the outside due to movement of the female terminals 1 when the male terminals are inserted in the female terminals 1. Particularly, even when the straight line connecting the screw holes 31, 32 is separate from the center 47 of gravity of the region 30 of the through holes, variations in the terminal holding force applied to each of the female terminals 1 by each of the terminal holding members 41 can be reduced, so that restrictions on a position etc. of the screw holes 31, 32 are eased and the fixing structure of the female connector can be designed easily.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

For example, in the embodiment, the elastic force of the terminal holding member 41 is reduced by lengthening the leg part 43 of the terminal holding member 41, but instead of this, the elastic force of the terminal holding member 41 can be reduced by decreasing a cross-sectional area of a thickness direction of the leg part 43 and the arm part 45 of the terminal holding member 41.

Also, the terminal holding member 41 is not limited to the L shape. For example, means such as a coil spring capable of holding the female terminals 1 and properly setting the elastic force can be used.

Also, the screw holes of the rear holder 7 are not limited to two screw holes. For example, in a case where three or more screw holes are formed, the screw holes are arranged so as to deviate to one side with respect to the center of gravity of the region of the through hole group. In that case, the screw holes may be arranged with the straight line connecting each of the screw holes deviating from the center of gravity of the region of the through hole group to the same side. By the above configurations, variations in the terminal holding force of each of the terminal holding members can be reduced by the fixing structure of the connector of the embodiment.

Also, a shape of the base plate 25 is not limited to that of the embodiment, and can properly be designed in, for example, a quadrilateral or a circle according to the circuit substrate etc. of the back side of the rear holder.

Also, the elastic force of each of the terminal holding members 41 formed in the region 30 of the through hole group can properly be designed and, for example, can be increased gradually as the terminal holding member is separate from the screw holes 31, 32.

Also, the protrusions 21 of the housing 3 and the locking members 35 of the rear holder 7 can be omitted, but the female connector can be inserted and fixed in the casing wall 5 after the housing 3 and the rear holder 7 are fixed by the protrusions 21 and the locking members 35, so that work of insertion and fixing is facilitated.

Also, the thin-wall part 51 can be omitted when variations in the terminal holding force can be reduced sufficiently by adjusting the elastic force of each of the terminal holding members 41.

The present application is based on Japanese Patent Application No. 2010-006487 filed on Jan. 15, 2010, the contents of which are incorporated herein by way of reference.

INDUSTRIAL APPLICABILITY

The present invention is extremely useful to prevent the external force from being applied to the solder connection to the external electronic component due to the movement of the female terminal by the insertion force when the male connector is inserted in the female connector.

REFERENCE SIGNS LIST

1 Female Terminal
3 Housing
5 Casing Wall
7 Rear Holder
11 Conductive Part
12 Opening
13 Terminal Accommodating Chamber
15 Opening
17 Opening
19 Projection
25 Base Plate
27 Through Hole
30 Region of Through Hole Group
31 Screw Hole
32 Screw Hole
41 Terminal Holding Member
43 Leg Part
45 Arm Part
51 Thin-wall Part

The invention claimed is:

1. A fixing structure of a connector, comprising:

a housing, having a plurality of terminal accommodating chambers configured to respectively accommodate a plurality of female terminals; and a rear holder, by a plurality of screws, fixing the housing inserted into an opening formed in a casing in which an electronic device is accommodated, wherein the housing is formed with a plurality of first openings for insertion of mating terminals and a plurality of second openings for leading out conductive parts of the female terminals respectively, and has a projection contacting an edge portion of the opening of the casing and projected from an end face on which the second openings are formed, the rear holder has a base plate opposing the casing in a state where the projection is disposed therebetween, a plurality of first through holes formed on the base plate and corresponding to the second openings, a plurality of terminal holding members respectively provided at the first through holes and configured to come in contact with the female terminals respectively, and a plurality of second through holes through which the screws are inserted respectively, the second through holes are arranged so as to deviate to one side with respect to a center of gravity of a region in which the first through holes are formed, and elasticity of one of the terminal holding members which is disposed at a first position facing at least one of the second through holes in a peripheral part of the region are smaller than elasticity of another one of the terminal holding members which is disposed at a position except for the first position.

2. The fixing structure as set forth in claim 1, wherein each of the terminal holding members includes: a leg part which is cantilevered in the rear holder and extends along an inserting direction of the screws; and an arm part which extends from a free end of the leg part and is configured to come in contact with each of the female terminals, so as to form L-shape, and a length of the leg part of the one of the terminal holding members is longer than a length of the leg part of another one of the terminal holding members.

3. The fixing structure as set forth in claim 1, wherein the base plate has a thin-wall part at the one side with respect to the center of gravity of the region.

4. The fixing structure as set forth in claim 1, wherein a number of the second through holes is two, a straight line connecting the two second through holes is separated from the center of gravity of the region in which the first through holes are formed.

* * * * *